United States Patent [19]

Siemon

[11] 4,295,249

[45] Oct. 20, 1981

[54] COMBING MACHINE

[75] Inventor: Bernhard Siemon, Hanover, Fed. Rep. of Germany

[73] Assignee: Schubert & Salzer, Ingolstadt, Fed. Rep. of Germany

[21] Appl. No.: 85,415

[22] Filed: Oct. 16, 1979

[30] Foreign Application Priority Data

Oct. 18, 1978 [DE] Fed. Rep. of Germany ..... 2845245

[51] Int. Cl.[3] ..... D01G 19/16

[52] U.S. Cl. ..... 19/225

[58] Field of Search ..... 19/115 R, 215, 223, 19/225, 226, 227, 228, 235

[56] References Cited

U.S. PATENT DOCUMENTS

| | | | |
|---|---|---|---|
| 1,367,076 | 2/1921 | Nasmith | 19/225 |
| 1,401,179 | 12/1921 | Nasmith | 19/225 X |
| 1,534,783 | 4/1925 | Horridge | 19/225 X |
| 2,572,122 | 10/1951 | Dudley et al. | 19/225 X |
| 2,986,779 | 6/1961 | Lettermann | 19/225 X |
| 3,400,431 | 9/1968 | Strzelewicz | 19/225 |
| 3,479,699 | 11/1969 | Kaenel et al. | 19/225 X |

FOREIGN PATENT DOCUMENTS

| | | |
|---|---|---|
| 1161185 | 1/1964 | Fed. Rep. of Germany . |
| 1685576 | 5/1973 | Fed. Rep. of Germany . |
| 1685601 | 6/1977 | Fed. Rep. of Germany . |

*Primary Examiner*—Louis Rimrodt

*Attorney, Agent, or Firm*—Bailey, Dority & Flint

[57] ABSTRACT

A combing machine having stationary detaching rollers, a circular comb and a reciprocating gripper. A first crank means is mounted on a gripper oscillation shaft and is pivotally connected to a lower gripper plate. A second driven crank means is pivotally connected by means of a guide link to the lower gripper plate for producing an effective combing relation between the gripper and the circular comb.

4 Claims, 2 Drawing Figures

COMBING MACHINE

BACKGROUND OF THE INVENTION

The present invention relates to a combing machine with stationary detaching rollers and a reciprocating gripper which is part of the connecting rod of a linkage mechanism and is driven by a crank mounted on a gripper oscillation shaft and articulated to the lower gripper plate.

The requirements placed on a combing machine with oscillating gripper mechanism are high efficiency and good combing. In this connection, the efficiency of a combing machine is limited by the excitation of vibration arising from the intermittent operation. The magnitude of the vibration is considerably dependent on the mass acceleration forces of the oscillating gripper or a suspended pendulum gripper. The quality of the combing is dependent on the number of needles that sweep through the fiber beard. Good combing is hence only to be achieved when the path of the gripper jaw opening runs concentric to the circular comb, so that the fiber beard exit point has a small and constant distance from the needle tips of the comb segment, and a large number of needles sweep through the fiber beard.

Proposals have already been made to realize the path curve of the gripper opening required for good combing by means of an upright mounted gripper in which the lower gripper jaw is the connecting rod, or part of the connecting rod, of a four-link mechanism with a drive crank (DE-PS No. 1,161,185; DE-PS No. 1,685,601). Here, as against a suspended pendulum gripper, the oscillation path of the gripper to the detaching rollers, being half again as long and correspondingly requiring higher mass acceleration forces is disadvantageous; the position of the detaching rollers is established technologically by the path curve of the gripper opening in the phase of transfer of fiber material, and constructionally by the working region of the circular comb.

In the apparatus according to DE-PS No. 1,161,185, there further occurs an intersection of the working region of the circular comb and gripper mechanism, so that the time course of the gripper oscillation movement is positively dependent on the revolving movement and the dimensions of the circular comb. Such an intersection in fact does not occur in the combing machine disclosed in DE-PS No. 1,685,601. However, the stops provided here, for limitation of the angle which opens when the gripper swings back to a given value between the connecting rod and the link of the four-link mechanism which is pivotable about the needle tip circle, lead to a vibration excitation of the system and hence to unsteady running of the machine.

In a suspended pendulum gripper (DE-PS No. 1,685,576), the oscillation path of the gripper remains relatively short, as a result of the more favorable position of the detaching rollers which is possible here, so that the gripper accelerations and hence also the vibration excitations which influence smooth running of the machine become smaller. However, in this case there results from the path curve of the gripper opening, convex to the circular comb, a rapid lifting of the gripper from the needle tip circle, which is detrimental to good combing.

SUMMARY OF THE INVENTION

According to the present invention a gripper mechanism is provided which makes possible high productivity of a combing machine and simultaneously good combing by a circular comb.

Such is achieved according to the invention by a second drive crank, which is connected to a lower gripper plate by a guide link articulated to the lower gripper plate in the vicinity of the gripper opening.

In this way the close course of the path curve of the gripper opening to the needle tip circle, as required for good combing, is achieved. But simultaneously also a shortening of the oscillation path of the gripper is achieved. The shortening of the oscillation path, which is made possible by the second drive to lift the gripper towards the detaching rollers results in a smaller acceleration which in turn, leads to a reduction of the mass acceleration forces and hence of the stresses on the mechanism. The masses can hence be further reduced, in dimensioning the mechanism, by reduction of the load-bearing cross sections, so that, in all, the smoothness of running of the machine is improved and also the number of combing operations, and hence the productivity, is increased.

The second drive crank is conveniently mounted on the shaft of the circular comb. So that a path curve of the gripper opening concentric with the needle tip circle is here achieved, the circular comb is eccentrically arranged on its shaft, the eccentricity corresponding to the length of the second drive crank. In the embodiment as a suspended pendulum gripper, a second drive crank is fitted to the shaft of the lap tension roller, so that its movement is likewise utilized for the gripper drive.

Accordingly, it is an important object of the present invention to provide a drive mechanism for a gripper provided on a combing machine to produce high productivity.

Another important object of the present invention is to provide a relatively simple and reliable mechanism for reciprocating a gripper associated with a combing machine.

The construction designed to carry out the invention will be hereinafter described, together with other features thereof.

The invention will be more readily understood from a reading of the following specification and by reference to the accompanying drawing forming a part hereof, wherein an example of the invention is shown.

DESCRIPTION OF A PREFERRED EMBODIMENT

Figure 1:
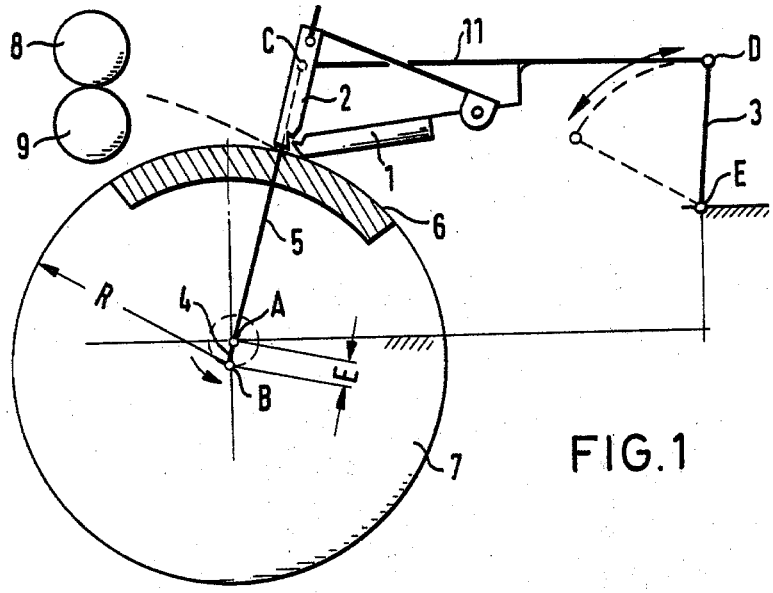
FIG. 1 is a side view illustrating schematically a upright arranged gripper with two drive cranks constructed in accordance with the present invention.

In FIG. 1, 1 denotes the lower gripper, 11 the lower gripper plate, and the upper gripper. The upper gripper 2 is jointed to the lower gripper 1 and is, for example, brought into clamping action by compressing of an elastic member (not shown).

The lower gripper drive consists of a five-link mechanism A, B, C, D, E with two drive cranks 3 and 4, the lower gripper plate 11 as the connecting rod, and a guide link 5. The lower gripper 1 is attached to the lower gripper plate 11 and hence is part of the connecting rod. The usual drive shaft lies at point E; from it, the drive crank 3 transmits the oscillating motion as shown by broken lines 30 to the lower gripper plate 11, to which it is articulated at its end remote from the detaching rollers 8, 9 at point D. A rotating circular comb 7 combs a fiber beard F which is held by the gripper.

The second crank 4 is mounted on the shaft, which lies at point A, of the circular comb 7, and movement of the drive crank 4 is transmitted to the lower gripper plate 11 or the lower gripper 1 by the guide link 5, which is connected at point B to the crank pin and articulated, at point C in the vicinity of the gripper opening, to the lower gripper plate 11. To correct the path curve of the gripper opening 12, the circular comb 7 is eccentrially mounted on its shaft, with the eccentricity E of the circular comb 7 corresponding to the length of the second drive crank 4. The arrangement is such that the crank pin of the second drive crank 4 and the center of the needle tip circle 6 of the circular comb 7 coincide at one point. If necessary, of course, the crank pin of the second drive crank 4 can be formed as an eccentric by enlargement of the pin.

In operation, the movements of the two drive cranks 3 and 4 add, thus giving the possibility of producing a path curve of the gripper opening which is suitable for good combing and the shortest possible oscillation path of the gripper. The drive crank 3 here produces the reciprocating oscillatory movement of the gripper. By the second drive crank 4, in cooperation with the needle tip circle 6, eccentric relative to the circular comb shaft, of the circular comb 7, there are effected the approach of the gripper to the needle tip circle 6 with the distance from the needle tip circle 6 remaining constant in the combing phase, and also, as in FIG. 1, the wide lifting of the gripper from the needle tip circle to the detaching rollers 8 and 9, by which is achieved a shortening of the oscillation path of the gripper.

The change of the distance between the gripper and the detaching rollers 8, 9 in the forward position, (i.e.) of the separation, can be carried out in the usual way on the oscillating drive crank by changing the crank position.

Figure 2:
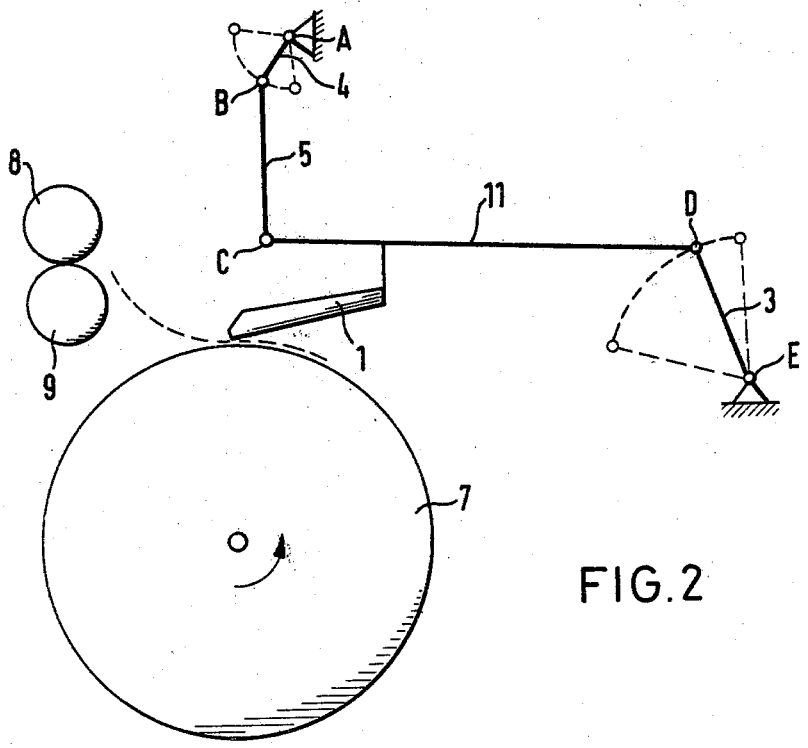
FIG. 2 is a side view illustrating schematically a suspended pendulum-type gripper provided with two crank shafts constructed in accordance with the present invention.

FIG. 2 shows the drive with the two drive cranks for a suspended pendulum gripper, all parts of the apparatus having the same reference numbers as in FIG. 1. The second drive crank 4 is in this case mounted at point A to the lap tensioning roller 40, which has an oscillating or revolving motion, and hence requires no additional drive. The lap tensioning roller 40 is supported on a shaft 41 which carries the second drive crank 4 at point A. The same advantages are thus obtained as regards the production of a path curve for the gripper opening which is suitable for combing and take-off as with the apparatus of FIG. 1.

While a preferred embodiment of the invention has been described using specific terms, such description is for illustrative purposes only, and it is to be understood that changes and variations may be made without departing from the spirit or scope of the following claims.

What is claimed is:

1. A combing machine having stationary detaching rollers (8, 9), a rotating circular comb (6) and reciprocating gripper, said gripper having a lower gripper plate (11) with a gripper opening provided adjacent thereto, said rotating circular comb combing a fiber beard held by said gripper, comprising:

a driven gripper oscillation shaft (E);

crank means mounted on said gripper oscillation shaft pivotally connected to said lower gripper plate (11);

a second driven crank means (4), and a guide link (5) pivotally connecting said second driven crank means (4) to said lower gripper plate (11) adjacent said gripper opening whereby effective combing is produced between said gripper and said circular comb.

2. The combing machine as set forth in claim 1 further comprising:

a rotating shaft extending through said circular comb rotating said circular comb; and said second driven crank means being mounted on said rotating shaft.

3. The combing machine as set forth in claim 2 further comprising:

said circular comb being arranged eccentrically on said rotating shaft, the eccentricity corresponding to the length of the second drive crank means.

4. The combing machine as set forth in claim 1 further comprising:

a lap tensioning roller;

a shaft supporting said lap tensioning roller, and said second drive crank being carried by said shaft supporting said lap tensioning roller.

* * * * *